United States Patent [19]

Prather

[11] 4,143,989

[45] Mar. 13, 1979

[54] ADJUSTABLE BRACE

[75] Inventor: Richard A. Prather, Hoffman Estates, Ill.

[73] Assignee: Rosetti Contracting Company, Ill.

[21] Appl. No.: 879,348

[22] Filed: Feb. 21, 1978

[51] Int. Cl.[2] ..... E02D 29/12

[52] U.S. Cl. ..... 404/72; 52/20; 404/4; 404/25

[58] Field of Search ..... 404/25, 26, 4, 72; 52/19, 20, 21; 248/357; 61/41 A, 45 C; 254/98, 102

[56] References Cited

U.S. PATENT DOCUMENTS

| | | | |
|---|---|---|---|
| 2,002,127 | 5/1935 | O'Neal | 52/20 |
| 2,004,335 | 6/1935 | Merriman | 404/25 |
| 2,254,668 | 9/1941 | Tomek | 404/26 |
| 2,532,168 | 11/1950 | Jakoubek | 61/45 C |
| 3,171,627 | 3/1965 | Tapley | 248/357 X |
| 3,355,136 | 11/1967 | Staples | 248/357 X |
| 3,426,659 | 2/1969 | Clarke | 404/25 |
| 3,945,746 | 3/1976 | Bredbenner | 404/4 |

*Primary Examiner*—Nile C. Byers, Jr.
*Attorney, Agent, or Firm*—Robert E. Wagner; Thomas L. Kautz

[57] ABSTRACT

An adjustable brace for securing the cap portion of a catch basin used in sewer systems to enable such cap portions to remain in place during continuous pouring of curb and gutter.

3 Claims, 3 Drawing Figures

ADJUSTABLE BRACE

BACKGROUND OF THE INVENTION

The present invention relates to an apparatus for use in road work such as paving and, more specifically, to a means for facilitating the pouring and shaping of concrete gutters and curbs.

In recent years, concrete gutters and curbs have been used extensively along roadways, generally replacing curbs formed of stone such as granite and the like. Paving machinery has been developed which travels along the edges or shoulders of such roadways, and simultaneously pours and forms a continuous length of concrete gutter and curb in a single operation. Such paving machinery has proved much more efficient and economical than laying lengths of stone curbing, or using forms and then hand finishing concrete gutters and curbing as in the past.

Adequate drainage of modern highways in both rural and urban areas requires the use of storm sewer systems along the shoulders of the roadway. The development of pre-cast reinforced concrete catch basins, which are lowered as a single unit into trenches dug for the storm sewers, has speeded up construction. Such catch basins created problems in using the continuous method of pouring concrete gutter and curbing machinery described above. A cast iron cap, which supports a grating or manhole cover, is placed over the opening in the catch basins and extends upwardly to the grade of the gutters. It has been found that the scraping and forming means associated with such machinery, which shapes the curbs and gutters, tends to push the cap away from the basin as it passes by, disrupting the entire operation.

Accordingly, it is current practice to remove the cast iron cap which covers the catch basin and allow the paving machinery to pour concrete over a temporary cover such as plywood and the like, placed over the catch basin, or into the open catch basin as the paving machinery passes by, so that it may continue uninterrupted for extended lengths of roadway. This practice results in depositing a quantity of concrete on the temporary cover or in the catch basin, which must be shoveled off of the cover, or out of the basin immediately by hand. The temporary cover may thus be removed, and the cap must be placed in the proper position over the opening in the catch basin. The concrete around the cap is replaced and the surrounding curbing and gutter must be hand finished before the surrounding concrete has hardened.

Considering that such catch basins may be placed at intervals of between 200 to 300 feet along most roadways, it is apparent that the present practices are costly and inefficient, requiring considerable manual labor. The present invention totally eliminates this practice with attendant cost savings.

SUMMARY OF THE INVENTION

The present invention provides an adjustable brace to secure the cap on top of the catch basin so that it will remain in place as the curb and gutter paving machinery passes by. This practice prevents the concrete from dropping into the catch basin or on top of a plywood cover, and eliminates hand finishing of the gutter and curb around the basin area.

The present invention includes an adjustable brace which extends from one edge of the catch basin diagonally across the opening in the basin to an upper edge of the cap. The adjustable brace includes a length of pipe having an angle iron welded on one end which contacts an edge of the catch basin. The other end of the pipe receives a loosely fitted threaded rod having a sharp point at its free end. Adjustment means is provided to extend the rod outwardly from the pipe so that its pointed free end contacts an upper edge of the cap to brace it against the catch basin and hold it securely in place as the gutter and curb machinery passes. The cap is closed by a manhole cover or grating, which is level with the grade of the gutter poured by such machinery, and thus, no concrete falls into the opening in the catch basin or accumulates on the top of the cap. Accordingly, the time consuming and uneconomical operations of removing the concrete from the catch basin or from on top of a cover placed over the basin, inserting the cap into the concrete adjacent the top of the catch basin, and then hand finishing the surrounding concrete have been eliminated by the present invention.

Therefore, it is an object of this invention to provide an adjustable brace means for securing the cap of a storm sewer system catch basin in place, during the operation of a paving machine for pouring concrete gutters and curbs in a continuous operation.

It is a further object of the present invention to provide an adjustable brace which permits storm sewer catch basins to be covered during the pouring of concrete gutters and curbs to eliminate various manual operations previously required to finish the gutter and curbing surrounding the basin.

It is another object of the present invention to provide an adjustable brace which may be lengthened and shortened to secure and brace the cap tightly against an edge of the catch basin and will permit it to be set without any additional tools such as a hammer or the like.

DESCRIPTION OF THE DRAWINGS

Objects in addition to the foregoing will become apparent from reference to the accompanying drawings and following description wherein.

DETAILED DESCRIPTION OF THE INVENTION

Figure 1:
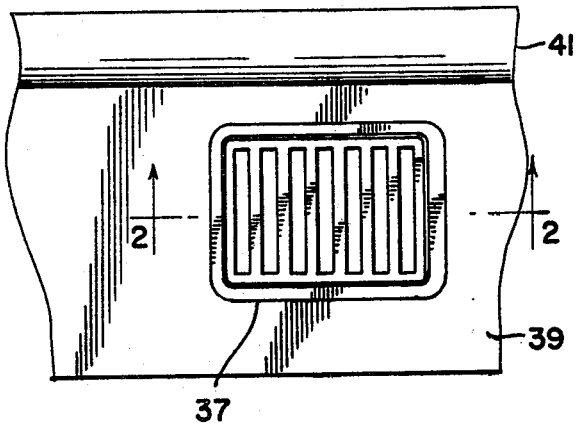
FIG. 1 is a plan view of a grating cover in position along a section of concrete gutter and curbing.
Figure 3:
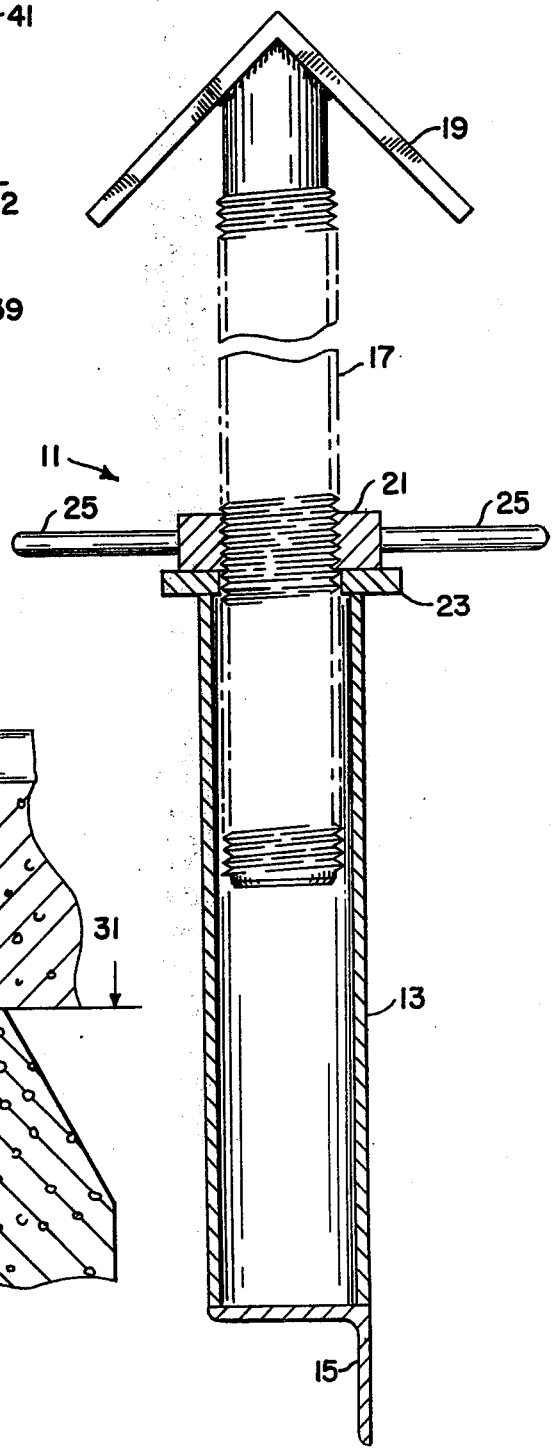

Referring now to the enlarged view of FIG. 3, the adjustable brace of the present invention is indicated generally by the reference 11. The brace 11 includes a hollow pipe 13 having an angle iron 15 welded on one end for purposes to become apparent below. The other end of the pipe 13 is open to loosely receive a threaded rod 17 formed with a sharp point 19 at its outwardly extending end. A nut 21 having outwardly extending ears or handles 25 on either side, is disposed along rod 17 and abuts a washer 23 which may be loosely received or welded on the open end of pipe 13. The length of rod received in the pipe 13 is adjusted by grasping nut 21 by its handles 25 and rotating it against washer 23 and the associated end of pipe 13. As the nut 21 bears against the washer 23 and pipe 13, the rod 17 moves inwardly and outwardly from the pipe 13, as desired, to adjust the over-all length of the brace 11. As evident in FIGS. 2 and 3, the rod 17 is made to loosely fit within pipe 13 to allow free movement of the rod 17 for purposes explained below.

Figure 2:
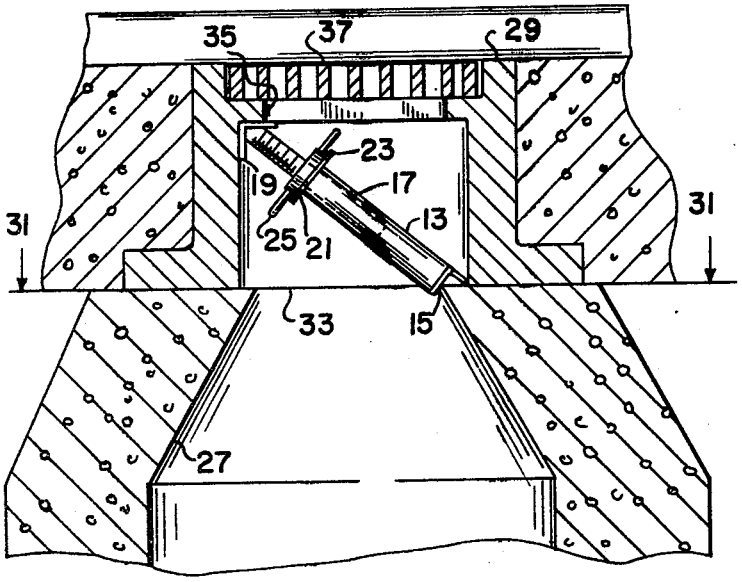
FIG. 2 is a partial cross-sectional view taken generally along line 2—2 of FIG. 1, showing the brace of the present invention in position between a storm sewer catch basin on its covering cap; and, FIG. 3 is an enlarged cross-sectional view of the brace of the present invention.

Referring now to FIG. 2, the use of the brace 11 will be described. It is shown in place between a catch basin 27 used in storm sewer systems, and a flanged cap 29 which rests on top of the basin 27. As mentioned above, modern storm sewer systems are provided with prefabricated reinforced concrete catch basins 27, which are placed into the trenches dug for the system and leveled with the grade line 31 of the road bed. In the past, paving machinery developed to pour concrete curbs and gutters in a continuous length, pushed the cap 29 away from the opening 33 in the catch basin 27 as it moved by, which disrupted the entire operation. No suitable means of securing the cap 29 in place over the opening 33 in basin 27 had been developed prior to the present invention and, accordingly, it has been common practice to remove the caps 29 from the basin 27, leaving the opening 33 uncovered, or to cover opening 33 with a temporary cover of plywood or the like to allow the curb and gutter paving machinery to proceed without interruption. As a result, a quantity of concrete is deposited in each of the catch basins 27 or on the plywood, which must be removed by hand immediately. Then, the cap 29 is manually placed on the top edges of the basin 27 and the gutters and curb adjacent the cap are filled in with concrete and hand finished.

The brace 11 of the present invention provides a means to secure the cap 29 in position on the basin 27 as the continuous gutter and curb paving machinery moves past. As shown in FIG. 2, the brace 11 is placed diagonally across the opening 33 between an edge of the catch basin 27 and an inwardly extending shoulder or ledge 35 of cap 29 upon which a grating or cover 37 is supported, and is angled toward the direction from which the paver approaches.

The rod 17 is loosely fitted within pipe 13, to assist in placement or seating of the brace 11 against the basin 27. At times, soil or other obstructions may be present on the top edge of basin 27 which would prevent solid contact between the pipe 13 and basin 27. In such instances, the rod 17 may be used as a hammer to pound the pipe 13 securely against the basin 27. The rod 17 is withdrawn from the pipe, and the nut 21 is driven against the washer 23 to force the pipe 13 and angle iron 15 against the basin 27. Thereafter, the rod 17 may be threaded outwardly from pipe 13 by rotating the nut 21 by its handles 25 against washer 23, to place the pointed end 19 of rod 17 firmly into contact with the ledge 35 of cap 29.

As is well known, the paving machinery used to pour the continuous layer of concrete for gutters and curbs includes a screed or scraping means to form and shape the concrete layer into curbs and gutters in a single or continuous operation. This scraping means, however, exerts a generally horizontal force on the cap 29, which tends to tilt or push the cap 29 from its position over the catch basin 27 if it is not anchored securely in place. The brace 11 of the present invention acts as a wedge between the cap 29 and basin 27 to resist this force. The angle iron 15 on the pipe 13 holds the pipe end of the brace 11 securely against the catch basin 27, and the pointed end 19 of the rod 17 of brace 11 contacts the ledge 35 of cap 29 to securely hold the cap 29 in place. Since the top surface of the cap 29 and cover 37 are level with the grade of the gutter 39 at the base of curb 41 (see FIG. 3), the scraping means merely follows such surface and leaves a minimum amount of concrete on the cover 37, which is easily removed. The machinery automatically pours concrete around the cap 29 when it is held in place by brace 11, and the gutter 39 and curbing 41 adjacent cap 29 are finished to their final shape as the machinery passes, thus eliminating virtually all of the manual labor and finishing work which was required in the past as described above.

Accordingly, a simple but effective means of securing the cap portion of a catch basin used in storm sewer systems is provided which enables such cap portions to remain in place as continuous pouring concrete gutter and curbing paving machinery pours and shapes the gutters and curbs along the edges of roadways.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. The method of pouring and forming concrete gutters and curbs in a continuous operation along the edges of a roadway having storm sewers including basins disposed at spaced intervals along said edges of said roadway and cap means disposed on the top edges of said basins for covering said basins, said cap means being secured over said basins by brace means extending between said basin and said cap means, said brace means including a pipe having an angle at one end and receiving a threaded rod at the other end, said rod having a free end formed to engage with said cap means, said rod being movable within said pipe by adjustment means including a nut and washer, said nut being mateable with said rod and rotatable against said washer to cause said rod to move in and out of said pipe, said rod and said nut being removable from said pipe, said method comprising the steps of:

placing said cap means over said basins along the edges of said roadway;

inserting said brace means into said cap means so that the end of said pipe having said angle is disposed adjacent an edge of said basin and said free end of said rod is disposed adjacent said cap means opposite said edge of said basin;

striking said nut against said washer for forcing said pipe and angle into positive contact with said edge of said basin;

rotating said nut against said washer for extending said rod outwardly from said pipe so that said free end of said rod contacts said cap means;

pouring a layer of concrete in a continuous length along the edges of said roadway and around said cap means; and, forming said layer of concrete into gutters and curbing.

2. In a system for pouring concrete gutters and curbs in a continuous operation to form the edges of a roadway having storm sewers, said storm sewers including a plurality of subterranean basins disposed at spaced intervals along the edges of said roadway, and cap means disposed on the top edges of said basins and covering said basins, said system including means for pouring a layer of concrete in a continuous length to form said edges of roadway, and scraper means for shaping said layer to form integral gutters and curbing, the improvement comprising brace means having a first member having one end formed to contact an inner edge of said cap means and a top edge of said basin, and a second member having one end formed to engage each edge of the interior corner of said cap means opposite said top edge of said basin, said second member being of smaller diameter than said first member to interfit therewithin, said second member being correspondingly threaded to receive a threaded member formed with handle means extending outwardly therefrom for rotating said threaded member, said brace having a bearing member disposed adjacent said first member, said second member interfitting within said first member to place said threaded member into contact with said bearing member, said threaded member being rotatable to bear against said bearing member for selectively moving said second member in and out of said first member to adjust the length of said brace means, whereby said brace means may be positioned between said cap means and said basin and adjusted to securely hold said cap means in place on said basin as said system pours said layer of concrete around said cap means and said scraper means forms said layer into gutters and curbing.

3. The brace means of claim 2 wherein said rod is loosely fitted within said pipe to permit removal therefrom, said pipe being forced and driven against said basin for positive contact therewith by withdrawing said rod from said pipe and striking said washer with said nut on said rod.

* * * * *